United States Patent [19]

Byrnes et al.

[11] 4,294,017

[45] Oct. 13, 1981

[54] ARCHERY SIGHTING DEVICE AND METHODS OF CONSTRUCTING AND UTILIZING SAME

[76] Inventors: Robert J. Byrnes, 4366 Genesee Rd.; Bruce R. Byrnes, 937 N. Monroe St., Apt. 4, both of Lapeer, Mich. 48446

[21] Appl. No.: 135,654

[22] Filed: Mar. 31, 1980

Related U.S. Application Data

[63] Continuation-in-part of Ser. No. 935,667, Sep. 19, 1978.

[51] Int. Cl.[3] ..... F41G 1/46

[52] U.S. Cl. ..... 33/265

[58] Field of Search ..... 33/265

[56] References Cited

U.S. PATENT DOCUMENTS

| | | | |
|---|---|---|---|
| 2,542,501 | 2/1951 | Fredrickson | 33/265 |
| 2,654,152 | 10/1953 | Vite | 33/265 |
| 2,893,124 | 7/1959 | Sundquist | 33/265 |
| 2,982,026 | 5/1961 | Peterson | 33/265 |
| 3,284,904 | 11/1966 | Rade | 33/265 |
| 3,410,644 | 11/1968 | McLendon | 33/265 |
| 3,864,836 | 2/1975 | Haines | 33/265 |
| 4,142,297 | 3/1979 | Altier | 33/265 |

OTHER PUBLICATIONS

"Archery", vol. 34 #12, Dec. 1962, p. 35.

*Primary Examiner*—Steven L. Stephan

*Attorney, Agent, or Firm*—Irving M. Weiner; Pamela S. Burt; John L. Shortley

[57] ABSTRACT

An archery sighting device which provides adjustment of the angle between an optical sight and an archery bow by sliding movement of a housing for the optical sight along a curved support member. A mounting bracket of the device is affixed to a side surface of the midsection of an archery bow. The curved support member providing angular adjustment of the optical sight has a radius of curvature proportional to the draw length of the archer, thus affording precise adjustment of the angle of the optical sight. A detent positioning arrangement is provided to enable the user to readily adjust the optical sight to the desired setting along the curved support member.

5 Claims, 11 Drawing Figures

ARCHERY SIGHTING DEVICE AND METHODS OF CONSTRUCTING AND UTILIZING SAME

CROSS-REFERENCE TO RELATED APPLICATION

The present application is a continuation-in-part of co-pending application Ser. No. 935,667 filed on Sept. 19, 1978.

BACKGROUND OF THE INVENTION

1. Field of the Invention

The present invention relates generally to an improved archery sighting device which provides adjustment of the relation between an optical sight and an archery bow for purposes of elevational correction between the archery bow and a target, in accordance with a predetermined range selected by the archer.

More particularly, the invention provides an archery sighting device which permits adjustment of an optical sight relative to the bow in consideration of target distance, arrow flight, wind conditions, draw length and anchor point of a particular archer, etc.

2. Description of Relevant Art

It is well known in the art of archery aiming devices, and particularly devices which include an optical sight or scope of the long eye-relief type, that very precise adjustments of the optical sight relative to the bow are necessary to ensure accurate aiming. Particularly, factors such as target distance, arrow flight, wind conditions, draw length and anchor point of a particular archer, etc., must necessarily be taken into consideration to ensure accurate positioning of the optical sight relative to the bow.

The following devices are illustrative of known archery aiming devices:

The "ARCHERY SIGHT" disclosed in U.S. Pat. No. 2,542,501 issued in 1951 to Fredrickson; the "BOW SIGHT" disclosed in U.S. Pat. No. 3,234,651 issued in 1966 to Rivers; the "ARCHERY AIMING DEVICE" disclosed in U.S. Pat. No. 3,302,292 issued in 1967 to Akin, Jr.; the "QUICK ADJUSTING BOW SIGHT" disclosed in U.S. Pat. No. 3,487,548 issued in 1970 to Frydenlund; the "ADJUSTABLE BOW SIGHT" disclosed in U.S. Pat. No. 3,787,984 issued in 1974 to Bear et al; and the "ARCHER'S BOW SIGHT" disclosed in U.S. Pat. No. 4,142,297 issued in 1979 to Altier.

Known attempts to provide an accurate archery aiming device, including the above set forth known devices, have generally failed to provide the adjustability necessary to ensure accurate positioning of the optical sight relative to the bow in consideration of the above-discussed critical factors.

The present invention provides an improved archery sighting device wherein the position of an optical sight or scope of the long eye-relief type relative to the bow itself is very precisely adjustable in accordance with target distance, arrow flight, draw length and anchor point of a particular archer, etc.

SUMMARY OF THE INVENTION

In a first embodiment of the invention, there is provided an archery sighting device which includes a mounting bracket, and first means for affixing the mounting bracket to the midsection of an archery bow. A curved elongated support member is rigidly affixed to the mounting bracket such that the curve thereof is concave relative to the archer when the mounting bracket is affixed to the archery bow. The curved support member has a radius of curvature which is proportional to the draw length of the archer, or to the distance from the anchor point to the sighting device. The curved support member is affixed to the mounting bracket such that the lower end of the curved support member extends freely. An optical sight housing member is slidably mounted on the curved support member, and is slidably movable along the length of the curved support member. An optical sight is mounted within the optical sight housing member such that the longitudinal axis of the optical sight extends substantially transversely to the longitudinal axis of the curved support member. Second means are provided for selectively securing the optical sight housing member at a desired predetermined position along the length of the curved support member.

It is an object of the invention to provide angular adjustment of the optical sight relative to the archery bow in response to sliding movement of the housing member along the curved support member, to permit the archer to make elevational corrections in accordance with a selected shooting range, and to ensure that the optical sight will be maintained in a position substantially parallel to the line of sight of the archer.

In another preferred embodiment of the invention, the archery sighting device further includes third means operatively cooperating with the second means, the curved support member, and the optical sight housing member; for defining detent positions of the optical sight housing member at predetermined locations along the curved support member. In this manner, the invention provides particular predetermined settings along the curved support member which permit ready positioning of the optical sight at particular elevational orientations relative to the bow in accordance with range considerations.

It is a further object of the invention to provide selective lateral adjustment of the optical sight relative to the bow to permit the archer to align the optical sight in consideration of arrow flight, such that the orientation of the optical sight will be maintained in parallel relation to the flight of the arrow, regardless of the elevational position of the optical sight relative to the bow. In this manner, compensation is afforded for imprecisions in the bow itself.

A further object of the invention resides in the provision of an optical sight housing member which permits selective angular adjustment of one portion thereof relative to another portion thereof, thus permitting slight angular adjustment between the optical sight and the bow, to provide the archer with means for aligning the optical sight with his own particular normal anchor point.

Other objects and details of the invention will become apparent from the following detailed description, when read in conjunction with the accompanying drawings.

DETAILED DESCRIPTION OF PREFERRED EMBODIMENTS

Figure 1:
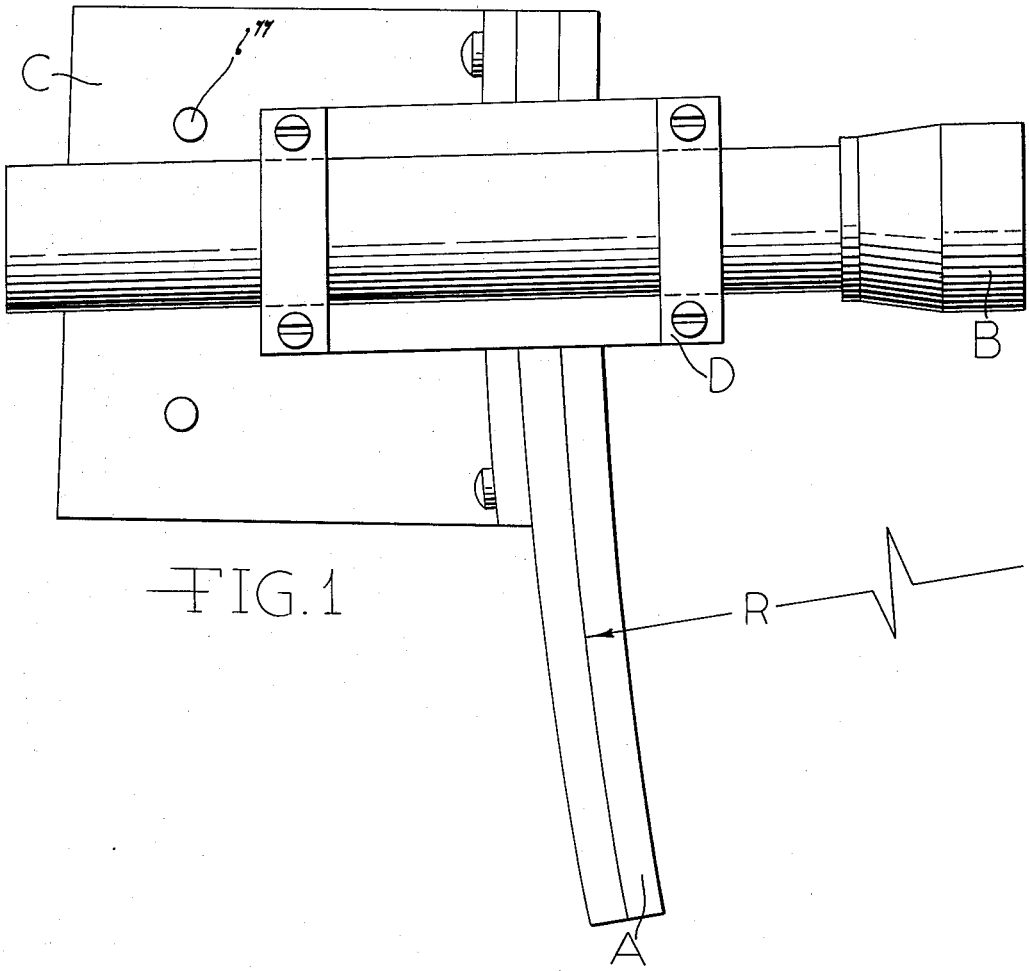
FIG. 1 is a side elevational view of the archery sighting device in accordance with a first embodiment of the invention.
Figure 2:
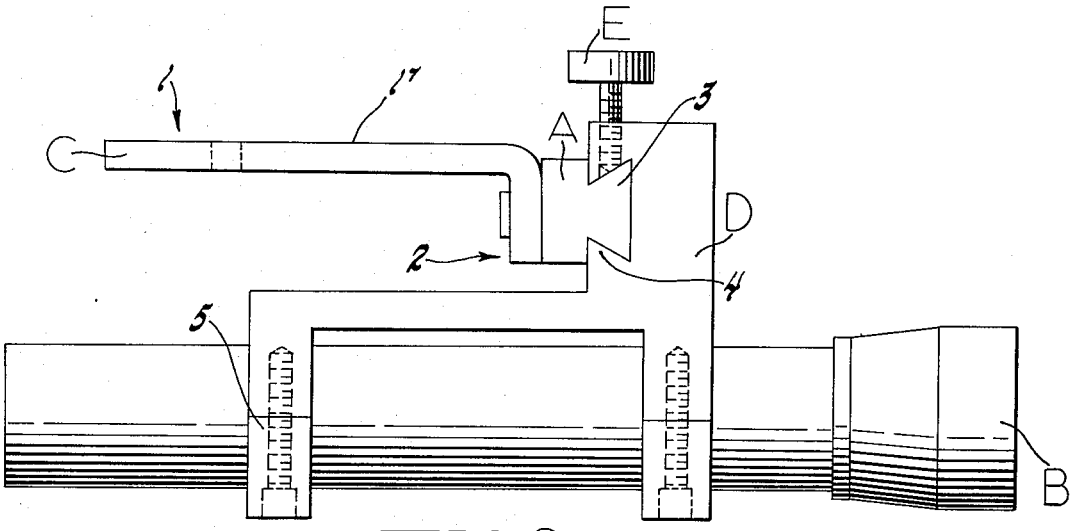
FIG. 2 is a top plan view of the FIG. 1 archery sighting device.
Figure 3:
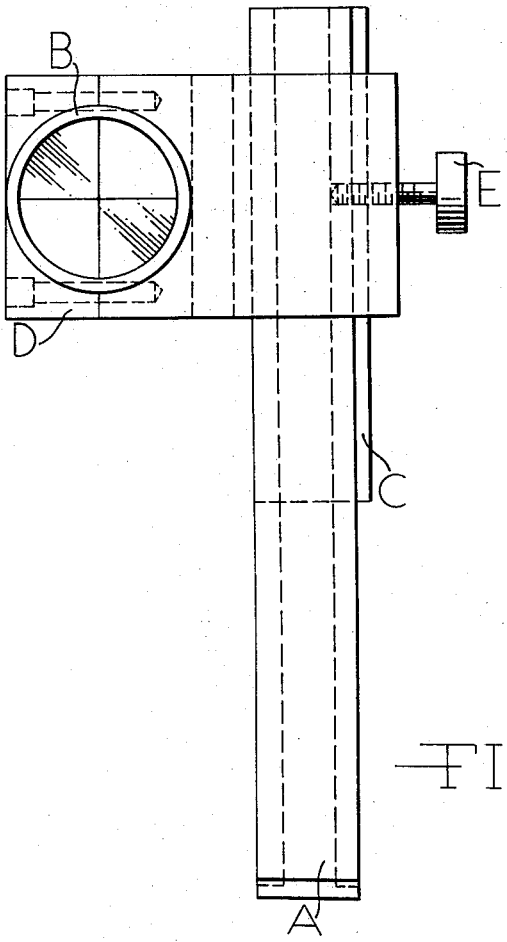
FIG. 3 illustrates a front view of the archery sighting device of FIG. 1, as seen from an operative archer's shooting position.

With reference to FIGS. 1-3, the archery sighting device in accordance with a first embodiment of the invention includes, generally, a mounting bracket C, a slidable optical sight housing member D, an optical sight B, and an elongated curved support member A.

Mounting bracket C comprises a substantially L-shaped plate member (FIG. 2), including a first portion 1 and a perpendicular second portion 2. The first portion 1 includes a mounting surface 1′ adapted to be mounted adjacent a side surface of the midsection or riser portion of a conventional archery bow. As shown in FIG. 1, first portion 1 includes a plurality of apertures 1″ through which suitable fastening means, such as threaded fasteners, are inserted and received within mating apertures provided in the side wall of the bow midsection (not shown). The second portion 2 of mounting bracket C has secured to the outer face thereof by means of threaded fasteners an upper portion of the rear convex surface of curved support A, as shown in FIGS. 1 and 2.

The curved support A comprises an elongated curved member which has a lower freely-extending end as shown in FIG. 1. The curved support A has a radius of curvature which is substantially proportional to the draw length of the archer, and is affixed to mounting bracket C such that the concave side thereof is facing the archer when the device is operatively mounted to an archery bow. Curved support A is provided along its length with a dovetail portion 3 as shown in FIG. 2. Dovetail portion 3 is adapted to slidably receive a mating dovetail portion 4 of optical sight housing member D, as also shown in FIG. 2.

Housing member D is further provided with a pair of support members 5 which support therein the optical sight B. As shown in FIG. 2, housing member D thus serves to support optical sight B in spaced relation relative to mounting bracket C, and substantially parallel to first portion 1 of bracket C. The mating dovetail portions 3 and 4 of curved support A and housing member D permit sliding movement of housing member D along the length of curved support A, in the up and down direction of FIG. 1. A locking screw E extends through a suitable aperture in housing member D into butting engagement with a surface of the dovetail portion 3 of support A, to support housing D in a desired fixed position along curved support A. When it is desired to change the position of housing member D relative to curved support A, the user merely loosens locking screw E, slides housing D to the desired position, and then re-tightens locking screw E into butting engagement with curved support A.

The optical sight B as illustrated is of the long eye-relief scope type as commonly employed in archery sighting apparatus. Preferably, optical sight B is of the type which includes means for adjusting the reticle crosshairs thereof in accordance with windage and elevation considerations.

In use, the device is mounted to the midsection or riser portion of a conventional archery bow as described hereinabove. Housing D, which may be slidably received by the lower freely-extending end of curved support A, is then locked in position on support A via locking screw E. With the housing D secured as shown in FIG. 1, adjacent the upper end of curved support A, the angle between optical sight B and the bow is approximately 90° and defines a point-blank range optical sight position. When the archer wishes to adjust the optical sight in consideration of elevational corrections or changes in range, locking screw E is loosened and housing D is moved along support A to the desired position, at which point locking screw E is again tightened to secure housing D in the desired position. As housing D is moved downwardly along support A, the angle between the sight B and the bow is gradually increased. The greater the desired range, the lower housing D is secured on support A. In this manner, the archer is provided with the ability to adjust the angle of sight B in accordance with his range and shooting style in a very convenient and easy manner.

Figure 4:
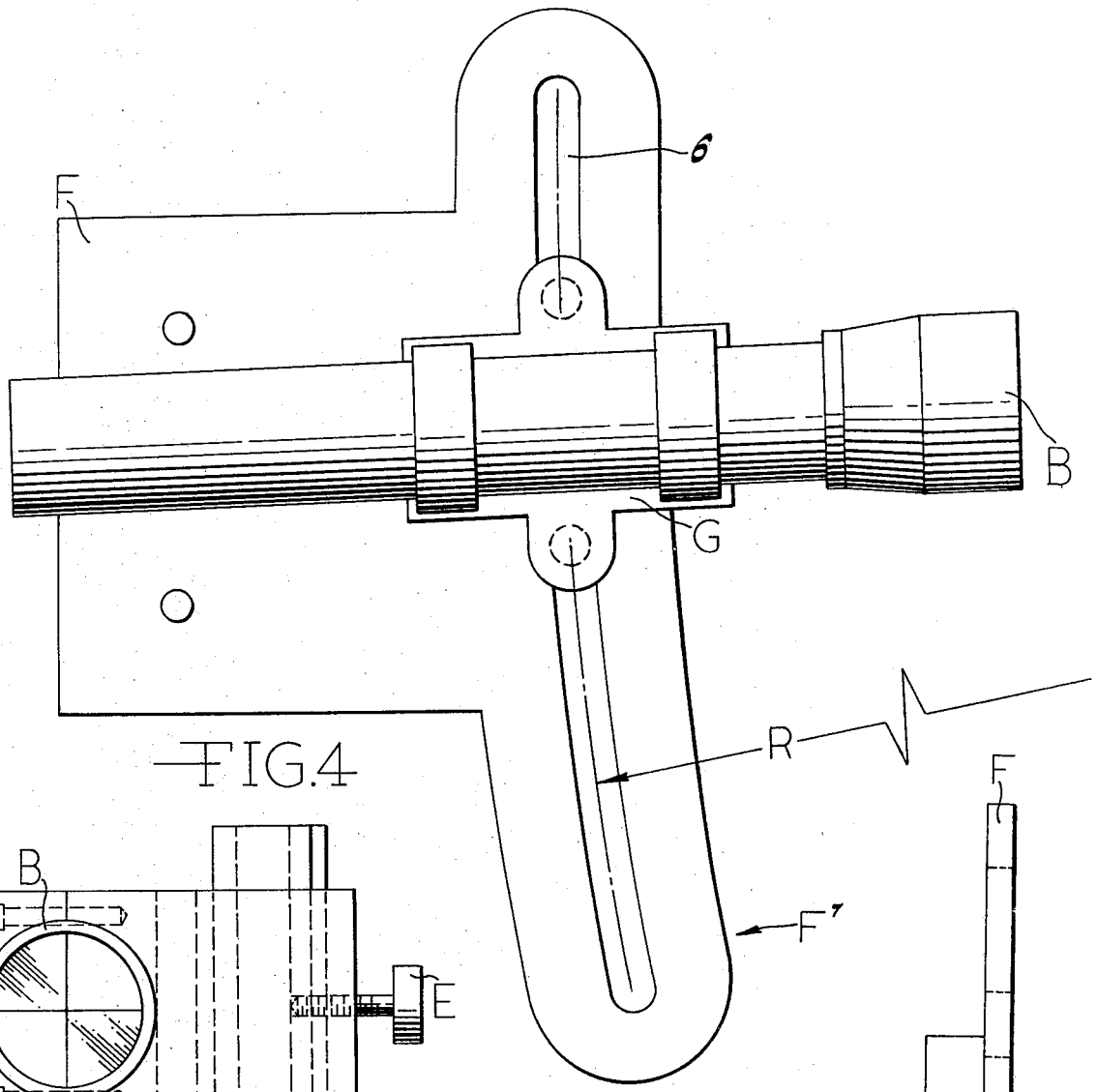
FIG. 4 is a side elevational view of a second embodiment of the archery sighting device.
Figure 5:
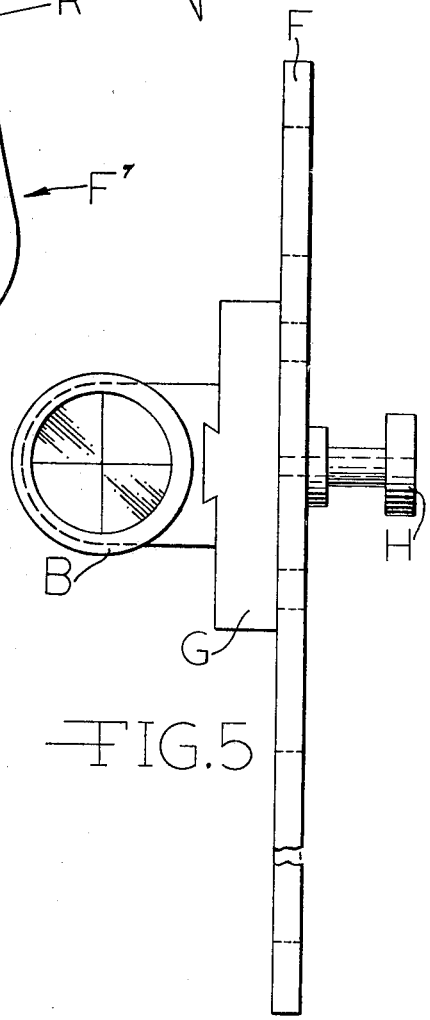
FIG. 5 illustrates a front view of the archery sighting device of FIG. 4, as seen from an operative archer's shooting position.

FIGS. 4 and 5 depict a second embodiment of the archery sighting device according to the invention, wherein mounting bracket F and curved support F′ are integrally combined to form a unitary construction. In this embodiment, the dovetail portion 3 of support A in the first embodiment is replaced by a longitudinal slot 6 in support F′. A pair of engaging lugs provided on housing G are received within slot 6 to permit sliding movement of housing G relative to support F′, and a locking screw H is employed in much the same manner as described hereinabove to secure housing G at the desired position on curved support F′. In other respects, the FIGS. 4-5 embodiment of the invention is much the same as the first embodiment described hereinabove.

It is contemplated that, if desired, the device according to the above-described embodiments of the invention may be provided with calibrations indicating particular settings for various ranges to facilitate adjustment of the optical sight housing member to the proper position along the curved support member.

With reference to FIGS. 6-11, there is shown an archery sighting device in accordance with a third preferred embodiment of the present invention. The optical sight 10 employed in such embodiment is of the long eye-relief scope type and is substantially identical to optical sight B described hereinabove. The optical sight 10 is provided with a pair of conventional adjustment knobs 10*a*, rotation of which will afford internal adjustment of the reticle crosshairs of the optical sight 10, to provide adjustments to compensate for windage and elevational considerations.

Figure 8:
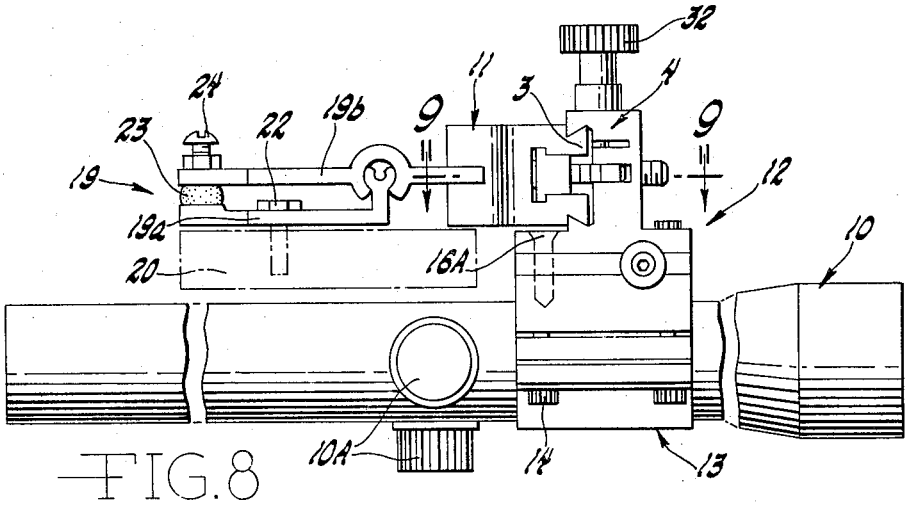
FIG. 8 depicts a top plan view of the archery sighting device of FIGS. 6 and 7.

As shown in FIG. 8, an elongated curved support member 11, which is similar to curved support member A described hereinabove, includes an elongated dovetail portion 3 for slidably receiving mating dovetail portion 4 of optical sight housing 12. The optical sight housing member 12 is substantially dissimilar to housing member D described with reference to FIGS. 1–3, as set forth below.

Figure 10:
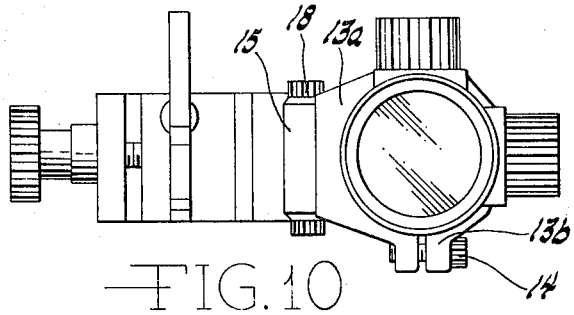
FIG. 10 illustrates a front elevational view of the optical sight housing of the FIG. 6 embodiment of the invention, having an optical sight mounted therein.

Housing member 12 includes a dovetail mating portion 4 (substantially the same as the FIGS. 1–3 embodiment), as well as an optical sight support cuff portion 13 defined by opposing cuff half portions 13*a* and 13*b* which are joined together at flanged mating portions thereof by a plurality of threaded fasteners 14, as shown in FIG. 10. The thus formed cuff portion 13 receives therein an optical sight 10 as shown in FIGS. 8 and 10, the sight 10 being secured in position by tightening fasteners 14. In this connection, in one working embodiment of the invention, cuff portion 13 was adapted to receive and support therein a standard one-inch diameter optical sight, however, it will be understood that cuff portion 13 may be readily modified to accommodate sights of various diameters.

Figure 9:
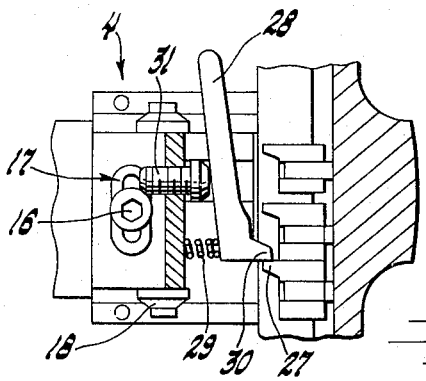
FIG. 9 is a partially sectioned view taken along line 9—9 in FIG. 8.

The cuff half 13*a* is secured to a plate member 15 (FIG. 10), the thickness of which may be varied to accommodate bow handles of varying thicknesses. Plate member 15 is in turn secured to dovetail mating portion 4 by means of allen screws 16 and 16A (FIGS. 9 and 8), screw 16 extending from plate 15 through an elongated slot 17 provided in housing portion 4 (FIG. 9). Provided on the respective upper and lower sides of plate 15 are adjusting screws 18 which cooperate with allen screws 16 and 16A in securing cuff portion 13 in fixed relation to housing portion 4. When the archery device is operatively mounted on a bow, such arrangement permits angular adjustment of cuff portion 13 (and sight 10 disposed therein) relative to housing portion 4, by loosening screw 16 to angularly adjust cuff portion 13 (screw 16A defining a pivot point) and thereafter tightening screw 16, with screws 18 providing a controlled means for adjusting the angle of cuff portion 13 relative to housing portion 4 by loosening one of the screws 18 and thereafter tightening the other screw 18 a like amount. In this manner, the archer is provided with an initial angular adjustment means for setting up the sight relative to his own particular anchor point and draw length. Once made, the adjustment remains substantially permanent.

As shown in FIG. 8, the mounting bracket 19 of the present embodiment is of a substantially different construction than that of bracket C in FIG. 1. Mounting bracket 19 is defined by a first ball hinge bracket portion 19*a* which is operatively and hingedly connected with a second socket hinge bracket portion 19*b*. Ball hinge portion 19*a* is provided with a mounting surface adapted to be mounted adjacent a side surface of the midsection or riser portion 20 of a conventional archery bow, as shown in FIG. 8. At least one fastening member 22 is received within suitable apertures respectively provided in ball hinge portion 19*a* and the side surface of the riser portion 20 so as to secure ball hinge portion 19*a* to the bow. If desired, a protective material 21 (FIG. 7) may be disposed between hinge portion 19*a* and the riser portion 20. The rear end of socket hinge portion 19*b* is received within and secured to a receiving slot provided in the rear surface of curved support 11, as also shown in FIG. 8.

Disposed between hinge portions 19*a* and 19*b* is a pair of compressible spacer members 23. A threaded fastener 24 is received through each spacer 23, as well as through suitable apertures provided in each of the hinge portions, as shown in FIG. 8. With such arrangement, after the device has been operably mounted to the bow, lateral adjustment of the optical sight may be attained so as to align the optical sight with arrow flight. Such adjustment is accomplished by adjusting the relative angular orientation of hinge portion 19*b* relative to hinge portion 19*a* either by tightening fastener 24 to compress spacer 23, or by loosening fastener 24 to permit expansion of spacer 23. This hinge arrangement permits the archer to alter the lateral position of sight 10 via housing member 12 and curved support 11 such that the optical sight is properly aligned in generally parallel orientation relative to arrow flight. As in the above-discussed adjustment of the housing portions 4 and 13, such lateral adjustment will normally be effected only once and will remain substantially permanent.

Figure 6:
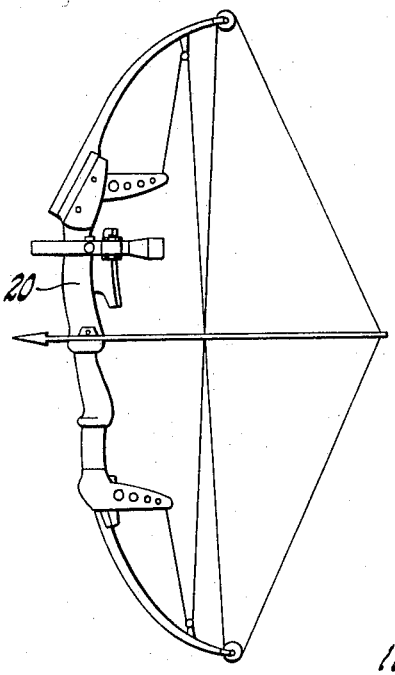
FIG. 6 is a side elevational view of an archery bow equipped with an archery sighting device in accordance with a third embodiment of the invention.
Figure 7:
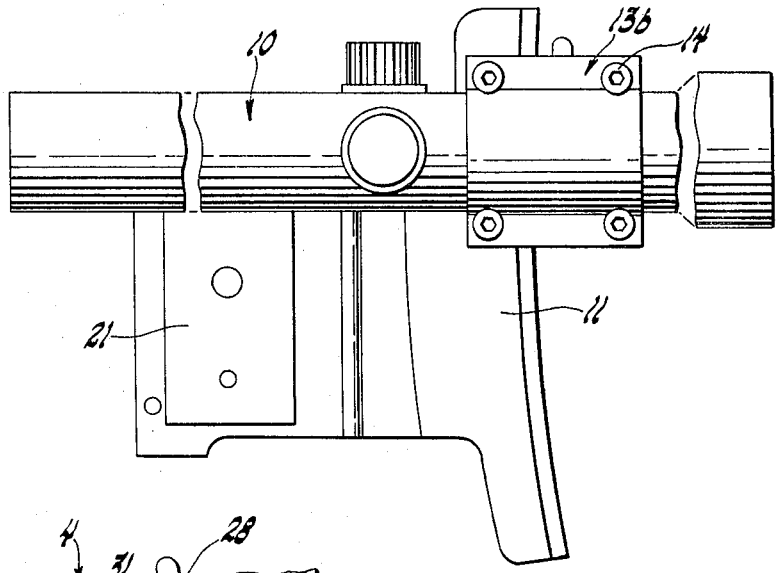
FIG. 7 is a side elevational view of the archery sighting device of FIG. 6.
Figure 11:
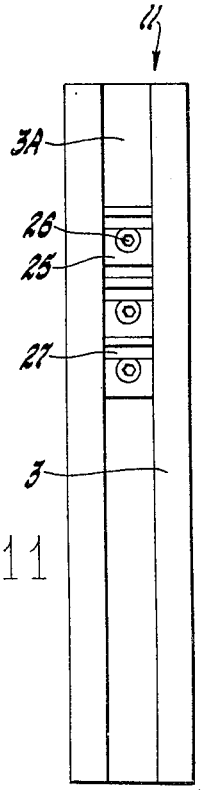
FIG. 11 depicts a front elevational view of the curved support member of the FIG. 6 embodiment, having a plurality of detent positioning blocks positioned therein.

With reference to FIGS. 6, 8 and 11, the novel detent position defining means in accordance with the third embodiment of the invention will be described. As shown in FIG. 11, the dovetail portion 3, which faces the archer when the device is disposed in an operable position on a bow, has disposed therebehind an elongated continuous slot 3A extending the entire length within curved support 11. As in the FIG. 1 embodiment, the dovetail portion 3 of curved support 11 has a radius of curvature which is substantially proportional to the draw length of the archer. In this connection, it will be understood that slot 3A of support 11 has substantially the same radius of curvature.

A plurality of detent positioning blocks 25 are dimensioned so as to be closely slidably received within curved slot 3A, and are each provided with a fastening member, such as an allen screw 26, for securing same in a desired position within slot 3A. Each positioning block 25 includes a detent tooth 27 protruding integrally forwardly therefrom.

As shown in FIGS. 8 and 9, the dovetail portion 4 of optical sight housing 12 has disposed therein a lever 28 which is disposed in substantially parallel relation to curved support 11 when housing member 12 is disposed on support 11. The lever 28 is biased by a spring 29 such that the lower end of lever 28, provided with a detent projection 30, is normally biased forwardly so as to be disposed within slot 3A of curved support 11. The detent projection 30 of lever 28 is adapted to cooperate with the respective detent teeth 27 of blocks 25 disposed within slot 3A of curved support 11 such that housing member 12 will be positioned at a particular point along the curved support member 11, depending upon which of the teeth 27 of blocks 25 is engaged by detent projection 30 of lever 28. A pin 31 is slidably received within the forward portion of dovetail housing portion 4 (FIG. 9) such that the inner end thereof bears against the central portion of lever 28.

In use, the device is mounted to the midsection or riser portion 20 of a conventional bow, as shown in FIG. 6, with housing 12 received at either end of curved support member 11 for slidable movement along support 11. In order to lock housing 12 at the desired elevational position along curved support 11, the user has merely to tighten a locking screw 32 provided in portion 4 of housing 12 so as to apply a squeezing force to dovetail portion 4 of housing 12 to lock same in position on dovetail portion 3 of support 11. With regard to blocks 25 (any desired number of which may be provided), the blocks are locked via allen screws 26 at particular positions within slot 3A of support 11. Such positions may correspond, for example, to target ranges of 10 yards, 20 yards, 35 yards, etc., each block corresponding to one particular range setting. When it is desired to employ blocks 25 to particularly position housing 12 at the desired setting, the user has merely to loosen locking screw 32 and to apply a pressing force either to the upper end of lever 28 or to the pressing pin 31 cooperating with lever 28. Such pressing force will cause detent projection 30 of lever 28 to be withdrawn from slot 3A of curved support 11, and will thus permit free sliding movement of housing member 12 along curved support 11. The pressing force is released from lever 28 when the detent projection 30 is properly aligned with respect to the tooth 27 of the desired positioning block 25, and the housing 12 will thus be properly positioned at the desired range setting. Thereafter, locking screw 32 is tightened to lock housing member 12 at such desired position.

With the detent positioning means as described hereinabove, the user is able to readily position the blocks 25 at the desired predetermined settings, and to readily position housing member 12 via lever 28 at the particular desired setting. As in the previous embodiments, the greater the desired range, the lower housing 12 is secured on curved support 11; and a point-blank range optical sight position is defined substantially adjacent the upper end of curved support 11.

It will be understood from the foregoing description of the various adjusting features provided in accordance with the present invention that the user is provided with a very substantial adjustability range of the position of optical sight 10 relative to the bow itself. Accordingly, all critical considerations, such as target distance, arrow flight, wind conditions, draw length and anchor point of a particular archer, and even imprecisions in the bow itself, may readily be compensated for merely by employing the various adjusting means for proper and precise orientation of optical sight 10 relative to the archery bow.

Although there have been described what are at present considered to be the preferred embodiments of the invention, it will be understood that various modifications may be made therein without departing from the spirit or essential characteristics thereof. The present embodiments are therefore to be considered in all respects as illustrative, and not restrictive. The scope of the invention is indicated by the appended claims rather than by the foregoing description.

We claim:

1. An archery sighting device comprising:

a mounting bracket;

first means for affixing said mounting bracket to the midsection of an archery bow;

a curved elongated support member directly rigidly affixed along a portion of the length thereof to said mounting bracket such that the curve thereof is concave relative to the archer when said mounting bracket is affixed to said archery bow;

said curved support member having a radius of curvature which is substantially proportional to the draw length of the archer;

said curved support member being affixed to said mounting bracket such that the lower end of said curved support member extends freely;

an optical sight housing member slidably mounted on said curved support member and slidably movable along the length of said curved support member;

an optical sight mounted within said optical sight housing member such that the longitudinal axis of said optical sight extends substantially transversely to the longitudinal axis of said curved support member;

second means for selectively securing said optical sight housing member at any desired position along the length of said curved support member;

third means operatively cooperating with said second means, said curved support member, and said optical sight housing member for defining detent positions of said optical sight housing member at selectively-predetermined locations along the length of said curved support member;

said curved support member being provided with a dovetail portion along the length thereof;

said optical sight housing member being provided with a dovetail mating portion received by said dovetail portion of said curved support member to permit said housing member to be slidably moved along the length of said curved support member;

said second means comprising a locking screw member extending through said optical sight housing member and adapted to secure said optical sight housing at a predetermined position along the length of said curved support member when said locking screw member is rotated to a locked position; and wherein said third means comprises:

at least one detent positioning block provided with a detent tooth and adapted to be slidably received within said dovetail portion of said curved support member;

fastening means for selectively securing said detent positioning block at any desired fixed position within said dovetail portion of said curved support member;

a spring-biased lever operatively disposed within said optical sight housing member, said lever including a detent projection portion; and said lever being selectively movable between a first position wherein said detent projection is in locking engagement with said detent tooth of said detent positioning block, and a second position wherein said detent projection is disengaged from said detent tooth of said detent positioning block.

2. An archery sighting device according to claim 1, wherein:

said mounting bracket comprises a hinged bracket which permits selective lateral positioning of said optical sight housing member relative to said bow.

3. An archery sighting device according to claim 2, wherein:

said hinged mounting bracket is defined by a first hinge bracket portion and a second hinge bracket portion;

said first hinge bracket portion includes a mounting surface for mounting adjacent a side surface of the midsection of an archery bow;

said first means for affixing said mounting bracket to said bow comprises at least one mating aperture provided respectively in said first hinge bracket portion and the side surface of the midsection of said bow for receiving a fastening member therethrough;

said curved support member is affixed to said second hinge bracket portion; and means are provided for adjustably securing said second hinge bracket portion at a selected angular orientation relative to said first hinge bracket portion, to permit selective lateral positioning of said optical sight housing member relative to said bow.

4. An archery sighting device according to claim 1, wherein: said optical sight is of the long eye-relief type.

5. An archery sighting device according to claim 1, wherein:

said optical sight housing member further includes an optical sight support cuff portion secured to said dovetail mating portion of said housing member;

said support cuff portion is angularly adjustable relative to said dovetail mating portion;

fastening means are provided for selectively securing said support cuff portion at a predetermined angular position relative to said dovetail mating portion of said housing member; and said optical sight is disposed within said support cuff portion of said housing member.

* * * * *